US009237606B2

(12) United States Patent
Yue et al.

(10) Patent No.: US 9,237,606 B2
(45) Date of Patent: Jan. 12, 2016

(54) CARBON NANOTUBE SHEET HEATER

(75) Inventors: Seong-Hoon Yue, Seongnam-si (KR); Yong-Bae Jung, Cheongju-si (KR); Jong-Bum Kim, Daejeon (KR)

(73) Assignee: LG HAUSYS, LTD., Seoul (KR)

( * ) Notice: Subject to any disclaimer, the term of this patent is extended or adjusted under 35 U.S.C. 154(b) by 355 days.

(21) Appl. No.: 13/147,810

(22) PCT Filed: Feb. 17, 2010

(86) PCT No.: PCT/KR2010/000965

§ 371 (c)(1),
(2), (4) Date: Aug. 4, 2011

(87) PCT Pub. No.: WO2010/095844

PCT Pub. Date: Aug. 26, 2010

(65) Prior Publication Data

US 2012/0125914 A1 May 24, 2012

(30) Foreign Application Priority Data

Feb. 17, 2009 (KR) ..... 10-2009-0012686

(51) Int. Cl.
*H05B 3/10* (2006.01)
*H05B 3/34* (2006.01)

(52) U.S. Cl.
CPC ..... *H05B 3/34* (2013.01); *H05B 2203/004* (2013.01); *H05B 2203/013* (2013.01); *H05B 2203/029* (2013.01); *H05B 2214/04* (2013.01)

(58) Field of Classification Search
CPC ..... H05B 2203/004; H05B 3/34; H05B 2214/04; H05B 2203/029; H05B 2203/013
USPC ..... 219/548, 546, 511, 553; 977/734, 742
See application file for complete search history.

(56) References Cited

U.S. PATENT DOCUMENTS

| | | | | |
|---|---|---|---|---|
| 6,084,217 | A * | 7/2000 | Bulgajewski | 219/505 |
| 7,160,530 | B2 * | 1/2007 | Dillon et al. | 423/447.1 |
| 2003/0026985 | A1 * | 2/2003 | Greiner et al. | 428/373 |
| 2003/0122133 | A1 * | 7/2003 | Choi et al. | 257/77 |
| 2007/0029309 | A1 * | 2/2007 | Keite-Telgenbuscher et al. | 219/549 |
| 2008/0028697 | A1 | 2/2008 | Li et al. | |

(Continued)

FOREIGN PATENT DOCUMENTS

| | | | |
|---|---|---|---|
| EP | 1 988 747 | A2 | 11/2008 |
| JP | 11-141901 | A | 5/1999 |

(Continued)

OTHER PUBLICATIONS

Yuan et al., "Electroless plating of carbon nanotube with copper", The Chinese Journal of Nonferrous Metals, (2004), vol. 14, No. 4, pp. 665-669.

*Primary Examiner* — Tu B Hoang
*Assistant Examiner* — Phuong Nguyen
(74) *Attorney, Agent, or Firm* — Nath, Goldberg & Meyer; Joshua B. Goldberg; Scott H. Blackman

(57) ABSTRACT

The present invention relates to a sheet heater produced by gravure printing, in which a silver paste is printed in a zigzag pattern between biaxially oriented transparent PET or OPS films and a CNT ink having excellent heat generating properties is coated in a sheet shape on the film, thereby preventing disconnection or fire and enabling temperature elevation in a short period of time while consuming less power.

5 Claims, 4 Drawing Sheets

(56) References Cited

U.S. PATENT DOCUMENTS

| | | | | |
|---|---|---|---|---|
| 2009/0008712 | A1 | 1/2009 | Choi et al. | |
| 2009/0194525 | A1* | 8/2009 | Lee et al. | 219/553 |
| 2009/0283754 | A1* | 11/2009 | Jiang et al. | 257/24 |
| 2009/0311554 | A1 | 12/2009 | Oh et al. | |
| 2009/0322221 | A1* | 12/2009 | Makansi | 313/523 |
| 2010/0177462 | A1* | 7/2010 | Adzic et al. | 361/502 |

FOREIGN PATENT DOCUMENTS

| | | | |
|---|---|---|---|
| JP | 2003-77923 | A | 3/2003 |
| JP | 2003-163104 | A | 6/2003 |
| JP | 2005-149877 | A | 6/2005 |
| JP | 2007-109640 | A | 4/2007 |
| JP | 2008-123784 | A | 5/2008 |
| JP | 2008-153049 | A | 7/2008 |
| JP | 2009-1481 | A | 1/2009 |
| KR | 20-0207322 | Y1 | 12/2000 |
| KR | 1020010076114 | A | 8/2001 |
| KR | 10-0644089 | B1 | 3/2002 |
| KR | 20-0300692 | Y1 | 1/2003 |
| KR | 10-2005-0011867 | A | 1/2005 |
| KR | 10-0813928 | B1 | 5/2006 |
| KR | 100583673 | B1 | 5/2006 |
| KR | 10-0642622 | B1 | 8/2006 |
| KR | 10-2007-0079862 | A | 8/2007 |
| KR | 10-0749886 | B1 | 8/2007 |
| KR | 10-2008-0030410 | A | 4/2008 |
| KR | 10-2008-0064571 | A | 7/2008 |
| WO | 2007/089118 | A1 | 8/2007 |
| WO | 2008/085550 | A2 | 7/2008 |
| WO | 2008/091003 | A2 | 7/2008 |

* cited by examiner

CARBON NANOTUBE SHEET HEATER

This is a National Phase Application filed under 35 U.S.C. 371 as a national stage of PCT/KR2010/000965, filed Feb. 17, 2010, and claims benefit from Korean Patent Application No. 10-2009-0012686, filed Feb. 17, 2009, the entire content of which is hereby incorporated by reference in its entirety.

TECHNICAL FIELD

The present invention relates to a polymer sheet heater produced by gravure printing a carbon nanotube (CNT) solution, and more particularly to a sheet heater produced by gravure printing, in which a silver paste is printed in a zigzag pattern between biaxially oriented transparent PET or OPS films, and a CNT ink having excellent heat generating properties is coated in a sheet shape on the film, thereby preventing disconnection or fire and enabling temperature elevation in a short period of time while consuming less power.

BACKGROUND ART

Generally, a sheet heater for vehicles is maintained at a constant temperature by supplying strong electric current to the heater through a thin electric wire to elevate the temperature of the heater to a desired temperature and controlling supply of electric current to the heater using a temperature sensor or bimetal regulator. However, this product is likely to undergo heat loss due to power interruption relating to disconnection of the electric wire or emission of heat from the electric wire and has low uniformity of heat generation due to manual arrangement of the electric wire.

Most sheet heaters for vehicles are designed to operate on 12 volts. When such a sheet heater is made of an existing carbon paste, the carbon paste is printed in a net shape to prevent local temperature increase and a silver paste for electrodes is used to form four or more wires in consideration of resistance variation according to distance and disconnection between the carbon paste and the silver paste, thereby limiting product size. Therefore, the existing carbon paste is not suitable for production of sheets type heaters having a size of more than 250×300 mm and operating on 12 volts and provides low thermal durability to a final product due to non-uniform heat generation.

FIG. 1 is a diagram of a heating mechanism of a conventional wire heating element. In this heater, since a contact surface between a heating wire and an object is limited, such heater exhibit poor heat transfer to an object to be heated and slowly rises to a maximum operating temperature.

FIG. 4 shows an electric network structure of general carbon. For electric conduction through general carbon, carbon is partially mixed with metal with a binder to adhere particles to one another. Thus, when disconnection between the particles occurs, electric current is concentrated on a certain portion where the disconnection does not occur, so that heat is generated from the certain portion, causing disconnection of the certain portion through localized overheating.

Since a resistance paste prepared using general conductive carbon powder also has a negative temperature resistance factor of carbon, it is difficult to secure reliability due to reduction in resistance upon repeated use. Further, since a metallic material has a positive temperature resistance factor, it is difficult to secure reliability due to increase in resistance upon repeated use.

Korean Registered Utility Model No. 207322 discloses a car seat, which includes a cotton yarn or natural fibers as a warp, woven copper wires or natural fibers disposed in the same direction as the cotton yarn and separated a predetermined distance from each other, a heat generating yarn formed on the cotton yarns or natural fiber by carbon coating as a weft, a heating plate composed of upper and lower polyurethane coating layers, a temperature sensor attached to the heating plate to be turned on/off within a predetermined temperature range, and a connection terminal through which terminals of the copper wires are connected to a vehicle power supply.

Korean Registered Utility Model No. 300692 discloses a sheet type heating element, which is formed by screen printing and includes a bottom plate formed of a synthetic resin, a plurality of carbon paste lines formed on the bottom plate to provide a plurality of alternating ladder shapes, a plurality of silver paste lines connected to each other and each being deposited at one side of the carbon paste line or along an outer periphery of the carbon paste line to provide electrodes such that positive and negative electrodes alternate, a thin synthetic resin layer formed by coating and curing an insulating synthetic resin to a predetermined thickness and width on the carbon paste lines and silver paste lines, and a finishing plate formed of adhesive and bonding agents on the thin synthetic resin layer.

Korean Patent No. 644089 discloses a lumbar supporter which is provided as a back supporter of a vehicle seat and includes a heating wire embedded therein. The lumbar supporter includes a seat heat cushion and a seat heater back, each of which includes heat generating wires disposed on a plane of a heat resistant member and coupled at one side thereof to a connection jack to prevent disconnection of the wires due to user weight. In the seat heater cushion, a negative temperature coefficient (NTC) member is coupled to the other side of the heat generating wires to decrease resistance when the temperature of the heat generating wires increases. The NTC member is coupled at one side thereof to an electronic control unit (ECU) and a multi-stage variable regulator is coupled to one side of the ECU and the other side of the NTC member such that power is continuously turned on/off by resistance of the NTC and the regulator.

In the related art, although heating wires, carbon and the like are used as the heating element, carbon nanotube-based heating elements have yet to be introduced.

DISCLOSURE

Technical Problem

One aspect of the present invention is to provide a carbon nanotube sheet heater which employs carbon nanotubes as a heating element.

Technical Solution

In accordance with one aspect of the invention, a sheet heater includes a heat generating layer composed of carbon nanotubes.

In the present invention, the sheet heater is formed using a carbon nanotube (CNT) in an attempt to solve problems of the existing sheet heater using carbon paste, such as deformation of a sheet-shaped synthetic resin material due to increase in resistance resulting from temperature increase, local variation of resistance causing fire, and the like, and employs a positive temperature coefficient (PTC) effect of CNT materials to maintain a balanced temperature after initial temperature elevation without using a separate over-current breaker such as an ECU. Further, the sheet heater includes biaxially oriented PET or OPS films to prevent contraction or expansion of seat fabrics upon heat generation from the films, thereby preventing resistance variation.

In the present invention, a CNT solution is used to allow the sheet heater to rapidly reach a desired temperature at 12 V, which is a typical operating voltage of a vehicle power supply, and to maintain the temperature based on the PCT properties of the CNT solution without a temperature regulator such as a bimetal regulator. CNT has an elongated hair structure and is highly electrically conductive in the horizontal direction of the hair structure. Further, since the sheet heater according to the invention is based on a principle of allowing electric current to flow through the entangled hair-shaped nanotubes, the sheet heater does not encounter significant resistance variation in a bent state. When applied to vehicles, the sheet heater according to the invention can also be bent due to user weight or friction with a user but does not suffer from significant resistance variation which occurs in the existing sheet heater.

The present invention can eliminate a separate anti-oxidation layer by printing CNT on a silver paste which forms an electrode layer. Since the silver paste exhibits excellent oxidizing power, the existing sheet heater requires coating of an insulation synthetic resin after screen printing.

A carbon nanotube is a new material constructed of hexagons each composed of six carbon atoms. Since the tube has a diameter of a few to dozens of nanometers, it is called a carbon nanotube. The carbon nanotubes have electrical conductivity similar to copper, the same thermal conductivity as diamond which has higher thermal conductivity than any other material in nature, and strength 100 times higher than steel. Although carbon fibers can be broken even by 1% deformation, carbon nanotubes can withstand up to 15% deformation.

In this invention, a metal doped carbon nanotube may be used as the carbon nanotube. Since a metal doped carbon nanotube paste has a temperature resistance factor approaching zero and does not suffer from resistance variation even upon repeated use of the sheet heater, the paste is used to secure reliability of the sheet heater. Metal doped to the carbon nanotube may assist in realizing characteristics of a positive temperature coefficient (PTC) thermistor and provides good electric current flow.

For example, silver, copper or the like may be used as the metal doped to the carbon nanotube. In terms of electrical conductivity and electrode compatibility, silver may be advantageously used.

In one exemplary embodiment, a sheet heater includes a base film, an electrode layer, a carbon nanotube heat generating layer, a film layer, an adhesive layer, and a protective layer from the top of the sheet heater.

In another exemplary embodiment, a sheet heater includes a base film, an electrode layer, a carbon nanotube heat generating layer, a film layer, an adhesive layer, and an insulator layer from the top of the sheet heater.

The carbon nanotube heat generating layer may be formed at either side thereof with a copper thin-film layer. As the copper thin-film layer, a copper foil exhibiting high electrical conductivity may be used to obtain more smooth flow of electric current. When the copper foil is used, it is possible to prevent non-uniform temperature distribution which occurs in existing sheet heaters.

The sheet heater may further include a conductive adhesive between the copper thin-film layer and the electrode layer. The conductive adhesive of the sheet heater may minimize contact resistance between the copper thin-film layer and the electrode layer, thereby preventing separation between the copper thin-film layer and the electrode layer due to failure of the copper thin-film layer.

The base film and the film layer may be formed of a flame retardant treated film to provide flame retardant characteristics of the third flame retardancy grade or more to the sheet heater.

The carbon nanotube sheet heater according to the invention may be used in various applications such as car rear-mirrors, seat heaters, sitting cushions, electric pads, and the like.

Advantageous Effects

According to exemplary embodiments, the carbon nanotube sheet heater has a wide heating area to provide excellent heat transfer and a short elevation time to maximum temperature. Further, since the carbon nanotube of the sheet heater has a configuration of entangled hair-shaped nanotubes, the sheet heater has excellent long term durability and many contact points, thereby preventing generation of short circuit or fire due to partial disconnection in the molecular structure of the carbon nanotube. Further, since the structure of the carbon nanotube sheet heater is similar to a fibrous structure and thus maintains an electrical network between carbon nanotubes even in the case where the nanotubes are separated from each other to some degree, the carbon nanotube sheet heater formed using a much smaller amount of carbon than the existing carbon heater may realize the same or higher performance than the existing sheet heater while securing electrical stability. Further, when metal is doped into the carbon nanotubes, the sheet heater has a temperature resistance factor substantially approaching 0 and does not undergo resistance variation even after repeated use. As a result, the sheet heater may easily secure reliability, have electrical network effects to thereby prevent disconnection resulting from heat concentration, and realize characteristics of a positive temperature coefficient (PTC) thermistor.

Figure 1:
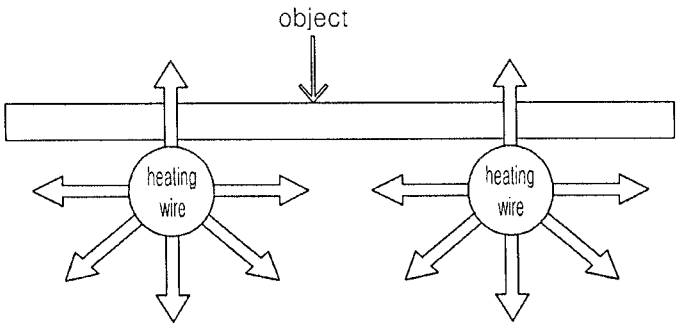
FIG. 1 is a diagram of a heating mechanism of a conventional wire heating element.

[Description of Reference Numerals for Main Components of the Drawings]

| | |
|---|---|
| 10: base film | 20: electrode layer |
| 30: carbon nanotube heat generating layer | 40: copper thin-film layer |
| 50: film layer | 60: adhesive layer |
| 70: protective layer | 80: insulator layer |

BEST MODE

Exemplary embodiments of the invention will now be described in detail with reference to the accompanying drawings.

Figure 2:
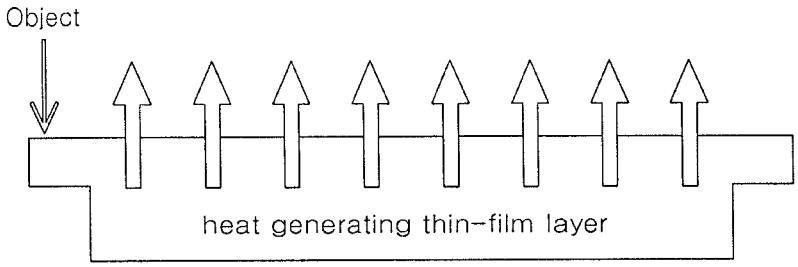
FIG. 2 is a diagram of a heating mechanism of a carbon nanotube heating element.

FIG. 2 is a diagram of a heating mechanism of a carbon nanotube heating element. Unlike the conventional wire heating element shown in FIG. 1, the carbon nanotube heating element allows a heat generating layer to contact an object on an overall upper surface of the heat generating layer, thereby providing excellent heat transfer efficiency and a short elevation time to maximum operating temperature.

Figure 3:
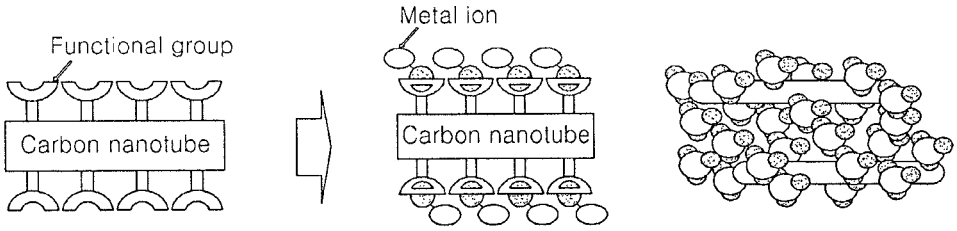
FIG. 3 is a flow diagram of a process of doping metal to a carbon nanotube.

FIG. 3 is a flow diagram of a process of doping metal to a carbon nanotube, showing chemical bonding between a carbon nanotube and metal elements. When the carbon nanotube is treated using an acid, functional groups are formed at terminals of the carbon nanotube as shown in the left side of FIG. 3. Then, when coating metal to the functional groups, metal ions are chemically coupled to the functional groups at the terminals of the carbon nanotube, as shown in the middle of FIG. 3. The right side of FIG. 3 shows metal-doped carbon nanotube powder.

Since a metal-carbon nanotube paste has a temperature resistance factor approaching zero and does not suffer from resistance variation even upon repeated use of a sheet heater formed using the paste, the paste is used to secure reliability of the sheet heater. Such properties are realized not only by mixing carbon having a negative temperature resistance factor and metal having a positive temperature resistance fact, but also by chemical bonding between metal particles and the surface of the carbon nanotube.

Figure 4:
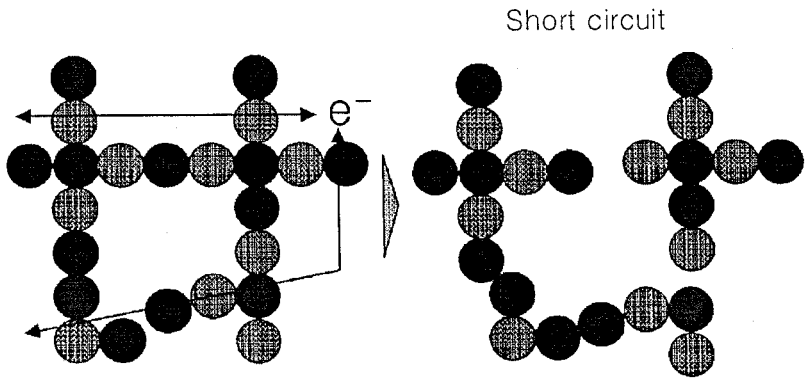
FIG. 4 is a configuration view of an electrical network of general carbon particles.
Figure 5:
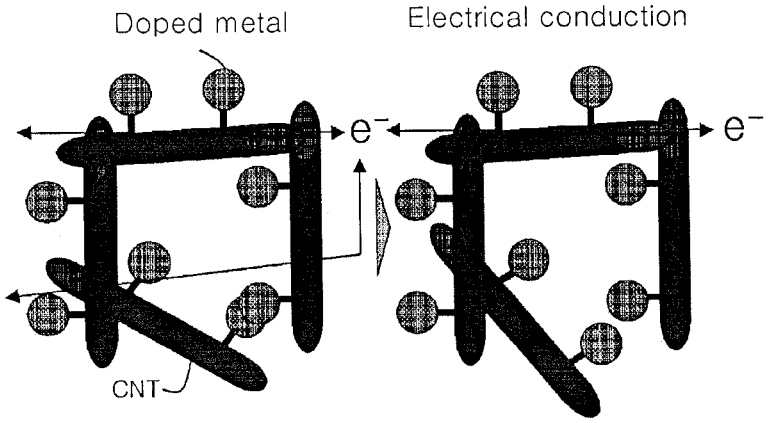
FIG. 5 is a configuration view of an electrical network of carbon nanotubes.

FIG. 5 is a configuration view of an electrical network of carbon nanotubes. When metal is doped to the carbon nanotubes, the carbon nanotubes provide an unbreakable electrical network and thus can avoid disconnection due to localized overheating, which occurs on the existing heater formed using general carbon powder as shown in FIG. 4. Further, since the structure of the carbon nanotube sheet heater is similar to a fibrous structure and thus maintains an electrical network between carbon nanotubes even in the case where the nanotubes are separated from each other to some degree, the carbon nanotube sheet heater formed using a much smaller amount of carbon than the existing carbon heater may realize the same or higher performance than the existing sheet heater while securing electrical stability.

Since the carbon nanotubes provide a configuration of entangled hair-shaped nanotubes, the sheet heater has excellent long term durability and many contact points, thereby preventing generation of short circuit or fire due to partial disconnection in the molecular structure of the carbon nanotube.

Figure 6:
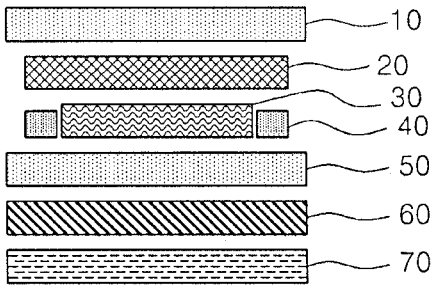
FIG. 6 is a sectional view of a carbon nanotube sheet heater according to one exemplary embodiment of the present invention.

FIG. 6 is a sectional view of a carbon nanotube sheet heater according to one exemplary embodiment of the invention. The carbon nanotube sheet heater according to this embodiment includes a base film 10, an electrode layer 20, a carbon nanotube heat generating layer 30, a copper thin-film layer 40, a film layer 50, an adhesive layer 60, and a protective layer 70 from the top of the sheet heater.

The base film 10 is a matrix on which the electrode layer 20 is printed and may include a biaxially oriented polyethylene terephthalate (PET) film or oriented polystyrene (OPS) film. The base film 10 may have a thickness of 100 μm or less. When using the biaxially oriented PET or OPS film as a printing matrix, the sheet heater may be heated to 160□ and may provide flame retardant characteristics of the third flame retardancy grade or more to the sheet heater through separate flame retardant treatment of the base film 10.

The electrode layer 20 is formed by printing a silver paste in a predetermined pattern on the base film 10 and has a narrower width than the base film 10. The electrode layer 20 allows electric current to be adjusted according to a distance between silver paste electrodes and width thereof such that a temperature elevation time and a temperature maintenance time of the carbon nanotube can be determined.

The carbon nanotube heat generating layer 30 is formed by printing and drying a carbon nanotube ink on the electrode layer 20. The carbon nanotube ink is a viscous ink for gravure printing, which is composed of a binder such as acryl resins, a dispersant, a stabilizer, and the like. The carbon nanotube heat generating layer 30 is formed in a predetermined pattern by gravure printing.

As to the carbon nanotube, a single-walled carbon nanotube (SWCNT) or a thin multi-walled carbon nanotube (thin MWCNT) is used for a transparent carbon-nanotube heating element, and MWCNT is used for a non-transparent carbon-nanotube heating element. When metal is doped into the carbon nanotube, it is possible to realize characteristics of a positive temperature coefficient (PTC) thermistor and to improve flow of electric current. The saturation temperature of the heating element may be determined by adjusting density of the carbon nanotubes and coating thickness.

The copper thin-film layer 40 is formed by combining copper thin films with both sides of the carbon nanotube heat generating layer 30. As the copper thin-film, a copper foil exhibiting high electrical conductivity may be used to obtain more smooth flow of electric current. Although other materials can be used for this layer, the copper foil may prevent non-uniform temperature distribution which occurs in the existing sheet heater. Further, a conductive adhesive may be used to minimize contact resistance between a copper portion of the copper thin-film layer 40 and the silver paste of the electrode layer 20 in order to prevent separation between the copper thin-film layer 40 and the electrode layer 20 due to failure of the copper thin-film layer 40.

The film layer 50 protects the electrode layer 20 and the carbon nanotube heat generating layer 30, and is formed through thermal combination of the same films as the base film 10.

The adhesive layer 60 may comprise acrylic, urethane, epoxy adhesives, and the like.

The protective layer 70 protects the adhesive layer 60 and is formed by combining protective films or paper sheets.

Figure 7:
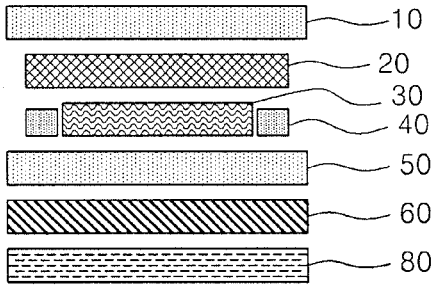
FIG. 7 is a sectional view of a carbon nanotube sheet heater according to another exemplary embodiment of the present invention.

FIG. 7 is a sectional view of a carbon nanotube sheet heater according to another exemplary embodiment of the present invention. The carbon nanotube sheet heater according to this embodiment includes a base film 10, an electrode layer 20, a carbon nanotube heat generating layer 30, a copper thin-film layer 40, a film layer 50, an adhesive layer 60, and an insulator layer 80 from the top of the sheet heater.

In this embodiment, the base film 10, electrode layer 20, carbon nanotube heat generating layer 30, copper thin-film layer 40, film layer 50, and adhesive layer 60 are the same as those of the carbon nanotube sheet heater shown in FIG. 6. In this embodiment, the sheet heater includes the insulator layer 80 instead of the protective layer 70.

The insulator layer 80 serves to prevent heat from leaking through the bottom of the heater and may be formed of an insulator such as polyurethane (PU), expanded polystyrene (EPS), expanded polypropylene (EPP), and the like.

Figure 8:
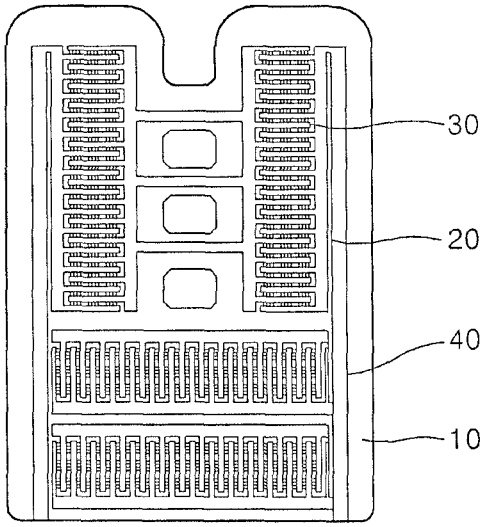
FIG. 8 is a plan view of a carbon nanotube sheet heater according to the present invention.

FIG. 8 is a plan view of a carbon nanotube sheet heater according to the present invention. In the sheet heater, the carbon nanotube heat generating layer 30 is printed in a zigzag pattern to have a wide area, so that a heat generating area increases, thereby improving energy transfer efficiency. It should be noted that the patterns of the electrode layer 20, the carbon nanotube heat generating layer 30, and the copper thin-film layer 40 in FIG. 8 are given for illustrative purposes and may be modified in various ways.

INDUSTRIAL APPLICABILITY

The present invention relates to a polymer sheet heater produced by gravure printing a carbon nanotube (CNT) solution, and more particularly to a sheet heater produced by gravure printing, in which a silver paste is printed in a zigzag pattern between biaxially oriented transparent PET or OPS films, and a CNT ink having excellent heat generating properties is coated in a sheet shape on the film, thereby preventing disconnection or fire and enabling temperature elevation in a short period of time while consuming less power. The carbon nanotube sheet heater according to the invention has a wide heating area to provide excellent heat transfer and a short elevation time to maximum temperature. Further, since the carbon nanotube of the sheet heater has a configuration of entangled hair-shaped nanotubes, the sheet heater has excellent long term durability and many contact points, thereby preventing generation of short circuit or fire due to partial disconnection in the molecular structure of the carbon nanotube. Further, since the structure of the carbon nanotube sheet heater is similar to a fibrous structure and thus maintains an electrical network between the carbon nanotubes even in the case where the carbon nanotubes are separated from each other to some degree, the carbon nanotube sheet heater formed using a much smaller amount of carbon than the existing carbon heater may realize the same or higher performance than the existing sheet heater while securing electrical stability. Further, when metal is doped into the carbon nanotubes, the sheet heater has a temperature resistance factor substantially approaching zero and does not undergo resistance variation even after repeated use. As a result, the sheet heater may easily secure reliability, have electrical network effects to thereby prevent disconnection resulting from heat concentration, and realize characteristics of a positive temperature coefficient (PTC) thermistor.

The invention claimed is:

1. A sheet heater comprising a base film, a printed electrode layer printed on the base film, a printed carbon nanotube heat generating layer printed on the electrode layer, a film layer, a copper thin film layer, an adhesive layer, and an insulator layer from said adhesive layer;

wherein the copper thin film layer is in contact with two planes of the carbon nanotube heat generating layer;

wherein the base film includes a biaxially oriented polyethylene terephthalate (PET) film or oriented polystyrene (OPS) film;

wherein the carbon nanotube heat generating layer includes metal-doped carbon nanotube, and is printed in a pre-determined pattern on the electrode layer; and wherein the insulator layer is formed of polyurethane (PU), expanded polystyrene (EPS), or expanded polypropylene (EPP), and the base film and the insulator layer are separate layers.

2. The sheet heater of claim 1, wherein a protective layer is included instead of said insulator layer.

3. The sheet heater of claim 2, wherein the film layer includes a biaxially oriented film.

4. The sheet heater of claim 1, wherein a conductive adhesive is deposited between the copper thin-film layer and the electrode layer.

5. The sheet heater of claim 1, wherein the film layer includes a biaxially oriented film.

* * * * *